United States Patent [19]

Lotz et al.

[11] Patent Number: 4,715,861

[45] Date of Patent: Dec. 29, 1987

[54] ECONOMY CHROME TANNING PROCESS WITH ALDEHYDE-ACIDS AND KETO-ACIDS

[75] Inventors: Werner Lotz, Niedernhausen; Karlheinz Fuchs, Hünfelden; Siegmund Haller, Kelkheim, all of Fed. Rep. of Germany

[73] Assignee: Hoechst Aktiengesellschaft, Frankfurt am Main, Fed. Rep. of Germany

[21] Appl. No.: 861,100

[22] Filed: May 8, 1986

[30] Foreign Application Priority Data

May 10, 1985 [DE] Fed. Rep. of Germany ..... 3516842

[51] Int. Cl.[4] ..... C14C 1/00

[52] U.S. Cl. ..... 8/94.18; 8/94.15

[58] Field of Search ..... 8/94.18, 94.21, 94.15

[56] References Cited

FOREIGN PATENT DOCUMENTS 2424300 11/1984 Fed. Rep. of Germany .

OTHER PUBLICATIONS

Fuchs, K., Haller, S., Lotz, W., AQEIC Bol Tec, 37(6), 195–205.

*Primary Examiner*—Paul Lieberman

*Assistant Examiner*—John F. McNally

[57] ABSTRACT

Economy chrome tanning process wherein the pelts are pretreated before the tanning with 0.1 to 2% of an aldehyde- or keto-acid, preferably with glyoxylic acid or pyruvic acid, and are then tanned by customary methods. In this pretreatment, which is preferably carried out in the pickle, the tanning requires a chromium supply of only 1.25 to 1.5% of $Cr_2O_3$ on weight of pelt. Despite this reduced amount of chrome tannin the results obtained are boil-resistant leathers with uniform chromium distribution, excellent color levelness and very good physical properties.

5 Claims, No Drawings

ECONOMY CHROME TANNING PROCESS WITH ALDEHYDE-ACIDS AND KETO-ACIDS

Chrome tanning is an essential step in leather production. To obtain a boil-resistant leather, conventional processes supply chromium salts in a concentration which corresponds to an equivalent of 2 to 2.5% of $Cr_2O_3$ on weight of pelt. However, of this amount only 70 to 80% is actually permanently fixed in the skin, so that 20 to 30% of the chrome tannin offered pass into the effluent.

Not only for economic but also for ecological reasons, there has therefore in the past been no shortage of attempts to improve the chromium fixation in the skin and to reduce the amount of chromium necessary for boil-resistant tanning.

For instance, by raising the pH value of the tanning liquor to beyond the customary level it is possible to improve the exhaustion of the chrome tannins. However, the resulting increased astringence of the chrome tannins leads to a wrinkled grain, i.e. to qualitatively inferior leathers. In addition, it is usually also necessary to accept a loss in area.

Furthermore, by raising the temperature of the tanning liquors from the customary 38° to 40° C. to about 45° C. it is possible to obtain improved exhaustion of the chrome tannins. However, the temperature increase likewise goes hand in hand with an increase in the astringence of the chrome tannins, so that here too there is a danger of wrinkled grain and reduced yield, i.e. of reduced quality of leather.

It is further known from German Pat. No. 2,424,300 that complexing aromatic-dicarboxylic and tricarboxylic acids, such as, for example, phthalic acid and/or salts thereof, are used in pickling or in chrome tanning in order to obtain improved fixation of the chromium in the skin. However, if they are used in the pickle, this results in a distinct reduction of the rate of penetration of the subsequent chrome tannins, uneven distribution of the chromium and in the case of thicker, unsplit pelts in some cases even in incomplete penetration of tannin.

If they are to be used in chrome tanning, diminishing these defects usually requires the tanning to be carried out in two stages by performing a mild pretanning at a low pH value with usually organically sequestered chromium(III) sulfate tannin, which is then followed by the addition of the complexing aromatic dicarboxylic and tricarboxylic acids alone or in the presence of further chrome tannin and/or of a basifying agent.

We have now found a new process wherewith the bath exhaustion and the distribution and fixation of the chrome tannins in the leather can be improved significantly by pretreating the pelts before the tanning with 0.1 to 2, preferably 0.25 to 2% of an aldehyde- or keto-acid and subsequently tanning them.

The aldehyde- and keto-acid is preferably glyoxylic acid, or even pyruvic acid. The pretreatment with these acids is effected from an aqueous liquor containing the above-mentioned concentrations. This pretreatment can be carried out separately, but expediently the pretreatment with these acids is combined with the pickling. The combination with the pickling also has the advantage that by adding the said acids to the pickle it is possible to dispense with the customarily concomitantly used sequestering acids such as formic acid or acetic acid. The pickle otherwise contains the customary, for this purpose, acids and salts in the customary concentrations.

The subsequent chrome tanning takes place with the customary commercial chromium(III) tannins using the processes known per se, in which even the modern self-basifying chromium(III) tannins can be used without problems.

It is similarly possible to tan using the process described above in the presence of aromatic dicarboxylic and tricarboxylic acids. However, for this tanning process it is of particular importance that, owing to the prior treatment of the pelts with the said acids, a reduced supply of chromium, namely 1.25 to 1.5% of $Cr_2O_3$ on weight of pelt, is sufficient to obtain boil-resistant leather having a very uniform chromium distribution, excellent color levelness and very good physical properties.

The advantage of the process according to the invention is that while using an amount of chrome tannin which is significantly reduced compared with the prior art the leather quality is not only not disadvantageously affected but is visibly improved in the physical properties such as tensile strength, elongation at break and tongue tear strength. In addition, given the significantly lower amount of chrome tannin used, the increased bath exhaustion and the improved fixation of the chrome tannin in the leather the residual chromium content of the exhausted tanning liquors can be kept below 0.1%. The advantages of the process according to the invention can be successfully utilized in chrome tanning of the conventional skins, such as, for example, cattle, pig, goat or sheep.

EXAMPLE 1

After a one-hour dirt soak with 500% of water at 25° C., cattle hide is subjected to the main wash with 500% of water at 25° C., 0.5% of the sodium salt of a benzenedisulfonic acid and 0.5% of a polyphosphate for 4 hours in a slowly rotating tanning drum.

The cattle hide is subsequently fleshed. Liming is effected in the tanning drum with 300% water at 22° C., 4% lime, 3% sodium sulfide, 0.1% alkylaryl polyglycol ether and 0.3% of the ammonium salt of a mixture of amidosulfuric and imidosulfuric acid. After addition of the reagents the tanning drum is allowed to revolve slowly for 30 minutes and is then agitated every hour for 4 minutes for a further 23.5 hours. After conclusion of liming the liquor is discharged, and the unsplit cattle hide is rinsed with water at 22° C., is weighed and is then rinsed once more for 10 minutes with water at 30° C.

To obtain deliming and bating, the pelt is introduced into 250% of water at 30° C. and 0.3% of polyphosphate. After 15 minutes of agitation the liquor is discharged and the pelt is agitated for 20 minutes in 250% water and 1% of the ammonium salt of a mixture of amidosulfuric and imidosulfuric acid. 2% of ammonium sulfate and 1% of sodium bisulfite are then added, followed by agitation for 60 minutes. 0.2% of a bacterial enzyme is then added, and agitation is continued for 30 minutes. Discharge of the liquor is followed by a 20-minute rinse with water at 18° C.

For the pickle, the pelt has added to it 50% water at 18° C. and 5% sodium chloride and is agitated for 10 minutes.

0.5% of sulfuric acid and 1.5% of a 50% strength aqueous glyoxylic acid solution are then added, and agitation is continued for 4 hours. Standing overnight is followed by addition of 0.2% sulfuric acid, and the tanning drum is agitated for a further hour.

6% of a pulverulent 33. basic chromium sulfate containing 26% of chromium oxide are then added and gradually neutralized with 1.4% of sodium bicarbonate.

After drumming overnight (total running time 18 hours) the final pH is 4.0, the final temperature is 42° C. and the residual chromium content of the tanning liquor is 0.06%.

The wet blue obtained is boil-resistant. The aniline leathers finished as usual have a particularly fine grain, a very soft pleasant hand and a high color levelness.

In the following examples the cattle skin was in each case treated up to the pickling stage in accordance with Example 1.

EXAMPLE 2

Cattle hide limed and bated as in Example 1 is taken up after a 20-minute rinse with water at 18° C. in a liquor of 50% water at 18° C. and 5% sodium chloride and is agitated in the tanning drum for 10 minutes.

0.5% sulfuric acid and 1.5% of 50% strength aqueous glyoxylic acid solution are then added, and agitation is continued for a further 4 hours. Standing overnight is followed by the addition of 5% of a pulverulent 33% basic chromium sulfate containing 26% chromium oxide and gradual neutralization with 0.35% of sodium bicarbonate.

After further drumming overnight (total running time 18 hours) the final pH is 3.8. The final temperatue is 43° C. and the residual chromium content of the liquor is 0.05%. The wet blue obtained is boil-resistant.

EXAMPLE 3

Cattle hide limed and bated as in Example 1 is taken up after a 20-minute rinse with water at 18° C. in a liquor of 50% water at 18° C. and 5% sodium chloride and is agitated in the tanning drum for 10 minutes.

0.5% sulfuric acid and 0.75% of 50% strength aqueous glyoxylic acid solution are then added, and agitation is continued for a further 4 hours. Standing overnight is followed by the addition of 6% of a pulverulent 33% basic chromium sulfate containing 26% chromium oxide and gradual neutralization with 0.35% of sodium bicarbonate.

After further drumming overnight (total running time 18 hours) the final pH is 4.0. The final temperature is 42° C. and the residual chromium content of the liquor is 0.07%. The wet blue obtained is boil-resistant.

EXAMPLE 4

Cattle hide limed and bated as in Example 1 is taken up after a 20-minute rinse with water at 18° C. in a liquor of 50% water at 18° C. and 5% sodium chloride and is agitated in the tanning drum for 10 minutes.

1.5% of a 50% strength aqueous glyoxylic acid solution are then added, and agitation is continued for a further 4 hours. Standing overnight is followed by addition of 4.1% of an organically sequestered chrome tannin having a basicity of 50% and 30% of chromium oxide. After a running time of 90 minutes 3.8% of a highly reactive organically sequestered chrome tannin containing 7.2% of chromium oxide are added.

After drumming overnight (total running time 18 hours) the final pH is, without additional neutralizing agents, 4.1. The final temperature is 42° C. and the residual chromium content of the liquor is 0.05%. The wet blue obtained is boil-resistant.

EXAMPLE 5

Cattle skin limed and bated as in Example 1 is taken up after a 20-minute rinse with water at 18° C. in a liquor of 50% of water at 18° C. and 5% of sodium chloride and is agitated in the tanning drum for 10 minutes.

0.5% of sulfuric acid and 1.0% of pyruvic acid are then added, and agitation is then continued for a further 5 hours. Standing overnight is followed by addition of 6% of a pulverulent 33% basic chromium sulfate containing 26% of chromium oxide and gradual neutralization with 1.2% of sodium bicarbonate.

After further drumming overnight (total running time 18 hours) the final pH is 4.2. The final temperature is 43° C. and the residual chromium content of the liquor is 0.1%.

We claim:

1. An economy chrome tanning process, which comprises pretreating the pelts before tanning with 0.1 to 2% of an aldehyde-acid or keto-acid and subsequently tanning the pretreated pelts.

2. The process as claimed in claim 1, wherein the pretreatment with the aldehyde-acid or keto-acid is carried out together with the pickling.

3. The process as claimed in claim 1, wherein the pelts are pretreated with glyoxylic acid.

4. The process as claimed in claim 1, wherein tanning is carried out with a chromium supply of 1.25 to 1.5% of $Cr_2O_3$ based on the weight of pelt.

5. The process as claimed in claim 1, wherein the pelts are pretreated with 0.25 to 2% of the aldehyde-acid or keto-acid.

* * * * *